US008105067B2

(12) United States Patent
Järvinen et al.

(10) Patent No.: US 8,105,067 B2
(45) Date of Patent: Jan. 31, 2012

(54) METHOD AND APPARATUS FOR CASTING CONCRETE PRODUCTS

(75) Inventors: Lassi Järvinen, Valkeakoski (FI); Aimo Seppänen, Sääksmäki (FI)

(73) Assignee: Elematic Oy AB, Toijala (FI)

( * ) Notice: Subject to any disclaimer, the term of this patent is extended or adjusted under 35 U.S.C. 154(b) by 7 days.

(21) Appl. No.: 12/149,359

(22) Filed: Apr. 30, 2008

(65) Prior Publication Data

US 2008/0277821 A1 Nov. 13, 2008

(30) Foreign Application Priority Data

May 9, 2007 (FI) ..... 20070363

(51) Int. Cl.
*B28B 3/00* (2006.01)

(52) U.S. Cl. ..... 425/204; 425/205; 425/208

(58) Field of Classification Search ..... 425/449, 425/208, 426, 204, 205, 209, 381, 447, 64, 425/114, 435, 432
See application file for complete search history.

(56) References Cited

U.S. PATENT DOCUMENTS

| | | | | |
|---|---|---|---|---|
| 3,788,612 A | | 1/1974 | Dray | |
| 4,133,619 A | | 1/1979 | Wise | |
| 4,674,971 A | | 6/1987 | Kankkunen | |
| 4,723,900 A | * | 2/1988 | Vuorenoja | 425/204 |
| 4,749,279 A | | 6/1988 | Csongor | |

FOREIGN PATENT DOCUMENTS

| | | |
|---|---|---|
| BE | 461162 A | 5/1947 |
| CA | 2455837 | 3/2004 |
| EP | 0 677 362 B1 | 12/2001 |
| FI | 80845 | 4/1990 |

OTHER PUBLICATIONS

Official Communication dated Oct. 4, 2010 for Canadian Patent Application No. 2,630,725.

International Search Report dated Aug. 16, 2010 for European Patent Application No. 08397507.

* cited by examiner

*Primary Examiner* — Christina Johnson
*Assistant Examiner* — Xue Liu
(74) *Attorney, Agent, or Firm* — Buchanan Ingersoll & Rooney PC

(57) ABSTRACT

A method and an apparatus for casting concrete products substantially with a horizontal slipforming process, the concrete mass in said method being fed by means of at least one feed element (2) through a limited cross section (13, 7, 8) for forming a concrete product, whereby the feed elements (2, 5, 15, 16) produce a two-directional compacting motion for compacting the concrete mass.

7 Claims, 3 Drawing Sheets

METHOD AND APPARATUS FOR CASTING CONCRETE PRODUCTS

BACKGROUND

1. Field

Disclosed herein is a method for casting concrete products by means of a substantially horizontal slipforming process, wherein the concrete mass is pressurized by means of one or more feed screws. More precisely, disclosed herein is a method and apparatus for casting a zero-slump concrete mass. The cast products may be hollow-core slabs or solid slabs.

2. Description of Related Art

When casting with traditional extruder and slipformer casting machines, the casting mold is formed by a casting bed and side walls and an upper surface moving along with the casting machine and forming the cross section of the product to be cast to the desired shape and size. When the casting machine proceeds, the side walls and the upper surface, and if necessary, the elements forming one or a plurality of hollow cores to the product to be cast, perform motion compacting the concrete mass. The ready-cast product remains on the casting bed to harden. Because the cast fresh slab remains lying on the casting bed in its final form, a high stiffness is required from the concrete mass to be used in the solutions of prior art.

The stiff concrete mass used in the solutions of prior art causes strong wear of the wear parts of the slipforming machine, like the feed screws and the hollow-core forming elements, whereby these wear parts must be changed relatively often. In connection with the change of the wear parts, also the casting process of the production plant must be interrupted for the duration of the change. The stiff concrete mass also causes mechanical burden on the processing devices, particularly on the structures involved in compaction of the concrete mass, like the troweling devices of the upper surface, side walls and the hollow-core mandrels, and the rotating devices of the screws, and degradation of the compacting efficiency caused by the fast wear. In known solutions, particularly with tall concrete products or with thick layers of concrete, the concrete does not compact uniformly throughout, causing unwanted variations in the quality of the end product.

The slipforming technique for manufacturing hollow-core slabs and massive slabs is well known in the art. For example Patent publication FI 80845 discloses a method and an apparatus for casting a hollow-core slab. The compacting method described therein is based on reciprocal swinging of the hollow-core mandrel simultaneously with the reciprocal longitudinal motion. Nowadays, the heights of the slabs are increasing, whereby also the heights of the hollow cores increase. In case of high hollow cores, with the described swinging of the hollow-core mandrel the adequate compacting of the concrete is not achieved.

In the compacting method described in patent publication FI 110174, a short reciprocal longitudinal motion of the hollow-core mandrels goes along an arch-like trajectory. When using this solution, vertical movement of the mandrels is obstructed by stiff, compacted mass surrounding the mandrels, and the adequate compacting of the concrete is not achieved. The obstruction of vertical movement of the mandrels causes additional burden on the driving devices and premature damages.

SUMMARY

Disclosed herein is a structurally simple slipforming machine for the slipforming process, comprising a two-directional compacting method that provides improved compaction results with less wear of components.

A two-directional compacting method as used herein refers to a compacting method wherein during compacting, the mass is deflected in at least two separate directions simultaneously in order to provide improved packing and compaction.

More precisely, in one embodiment, the method described herein relates to a method for casting concrete products substantially with a horizontal slipforming process, the concrete mass in said method being fed at least by means of one feed element (2) through a limited cross section (13, 7, 8) for forming a concrete product, wherein the feed elements (2, 5, 15, 16) produce a two-directional compacting motion for compacting the concrete mass and the two-directional compacting motion of the feed elements comprises a compacting motion substantially reciprocal with respect to the direction of casting and of a rotational compacting motion in a transversal direction with respect to the direction of casting, wherein the compacting motion substantially reciprocal with respect to the direction of casting is provided by means of a feed element consisting of at least a feed screw (2) and a bracket wheel (5, 15, 16) comprising at least one bracket, said bracket wheel being connected fixedly to the end of the feed screw, and the rotational compacting motion in the transversal direction with respect to the direction of casting is provided by means of the bracket wheel (5, 15, 16) of the feed element.

BRIEF DESCRIPTION OF THE DRAWINGS

The method and apparatus will be described in more detail in the following, with reference to the enclosed drawings, wherein.

DETAILED DESCRIPTION OF SPECIFIC EMBODIMENTS

Figure 1:
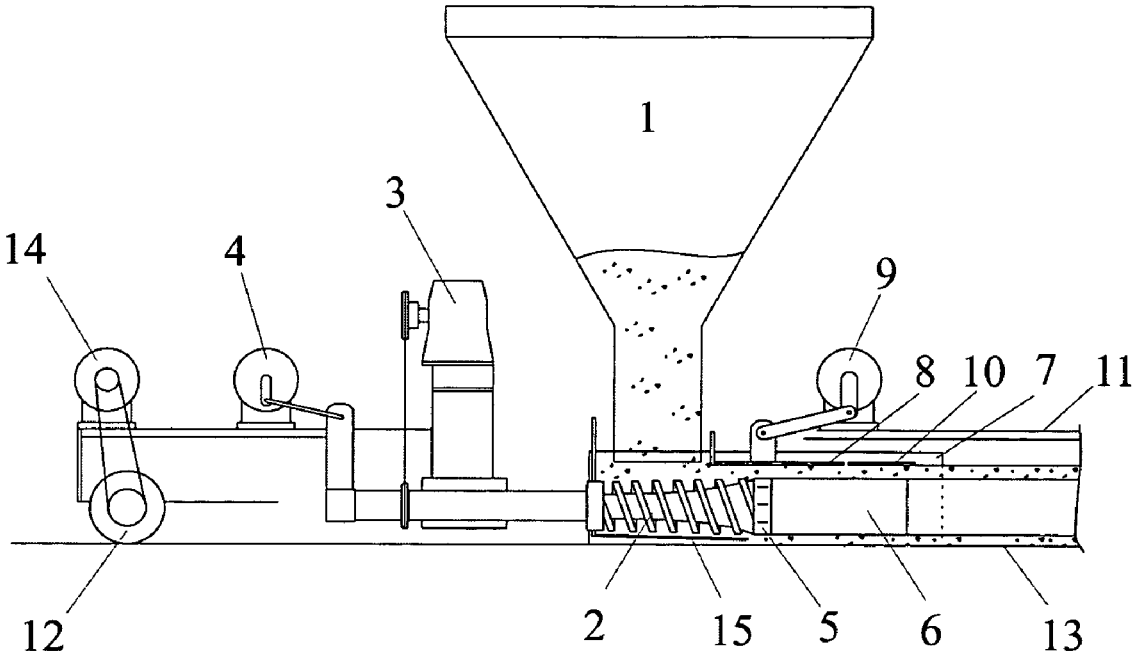
FIG. 1 shows a schematic view of one slipforming machine in accordance with an embodiment described herein.

Parts of the slipforming machine shown in FIG. 1 include the mass tank 1, feed screw 2, driving devices 3 and 4 of the feed screw, bracket wheel 5, hollow-core mandrel 6, side walls 7, troweling beam 8, driving devices 9 of the troweling beam, surface leveling plate 10, frame 11 of the casting machine, wheels 12 of the casting machine, casting bed 13, drive motor 14, and the chute 15 of the feed screw.

When using the casting machine shown in FIG. 1, stiff concrete mass is fed from the mass tank 1 to one or a plurality of feed screws 2. Each of the feed screws 2 is located in a chute 15 guiding the concrete mass to the feed screw at the forward end of the feed screw. The feed screws 2 extrude the concrete mass under pressure past the bracket wheel 5 to the restricted cross section defined by the casting bed 13, side walls 7 and troweling beam 8 defining the outer dimensions and the form of the product to be cast.

The rotating motion caused by the extrusion of the concrete mass by the feed screws 2 is provided by means of the driving device 3 of the rotating motion. The bracket wheel 5 having one or a plurality of brackets is mounted after the feed screws 2. When casting products with hollow cores, hollow-core mandrels 6 are mounted after the bracket wheel 5, said mandrels forming the hollow cores to the product to be cast.

During the cast, the apparatus supported by the wheels 12 carrying the frame 11, moves along the casting bed 13 driven by the reaction force of the feed screws 2. For moving the machine when it is empty, or for assisting in casting or adjusting the resistance to motion, the wheels of at least one end of the casting machine are rotated by means of the drive motor 14.

The product to be cast is compacted by means of a reciprocal motion of the feed screws 2 and the hollow-core mandrels 6, as well as by a compacting troweling motion of the side walls 7 and the troweling beam 8. In addition to the reciprocal compacting motion in one direction, the product to be cast is compacted by means of a rotating bracket wheel 5 causing transverse flow in the stream of mass extruded by feed screws. Reciprocal transversal flow is produced between adjacent bracket wheels, which, along with the longitudinal motion, in the concrete under pressure, forces the air out of the concrete mass and makes the constituents of the concrete mass to arrange themselves in an efficiently compacted manner.

Figure 2A:
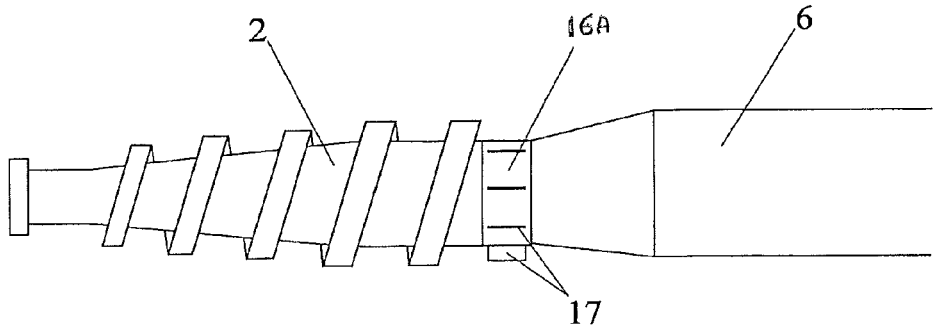
FIGS. 2A and 2B show schematic views of two alternative compacting elements in accordance embodiments described herein.
Figure 2B:
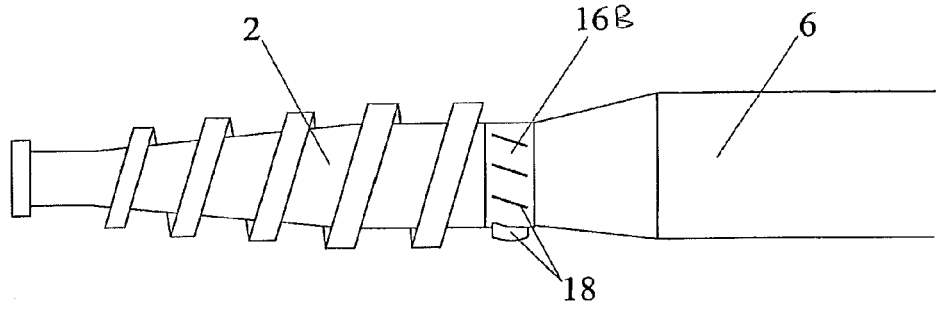

In FIGS. 2A and 2B, two alternative bracket wheels 16A and 16B, respectively are shown mounted in place between the feed screw 2 and the hollow-core mandrel 6. In the example of FIG. 2A, the brackets 17 of the bracket wheel 16A are parallel to the flow direction of the casting process. In the example of FIG. 2B, the brackets 18 of the bracket wheel 16B are angled with respect to the flow direction of the casting process, e.g. at an angle of 5 to 30 degrees with respect to the flow direction.

Figure 3:
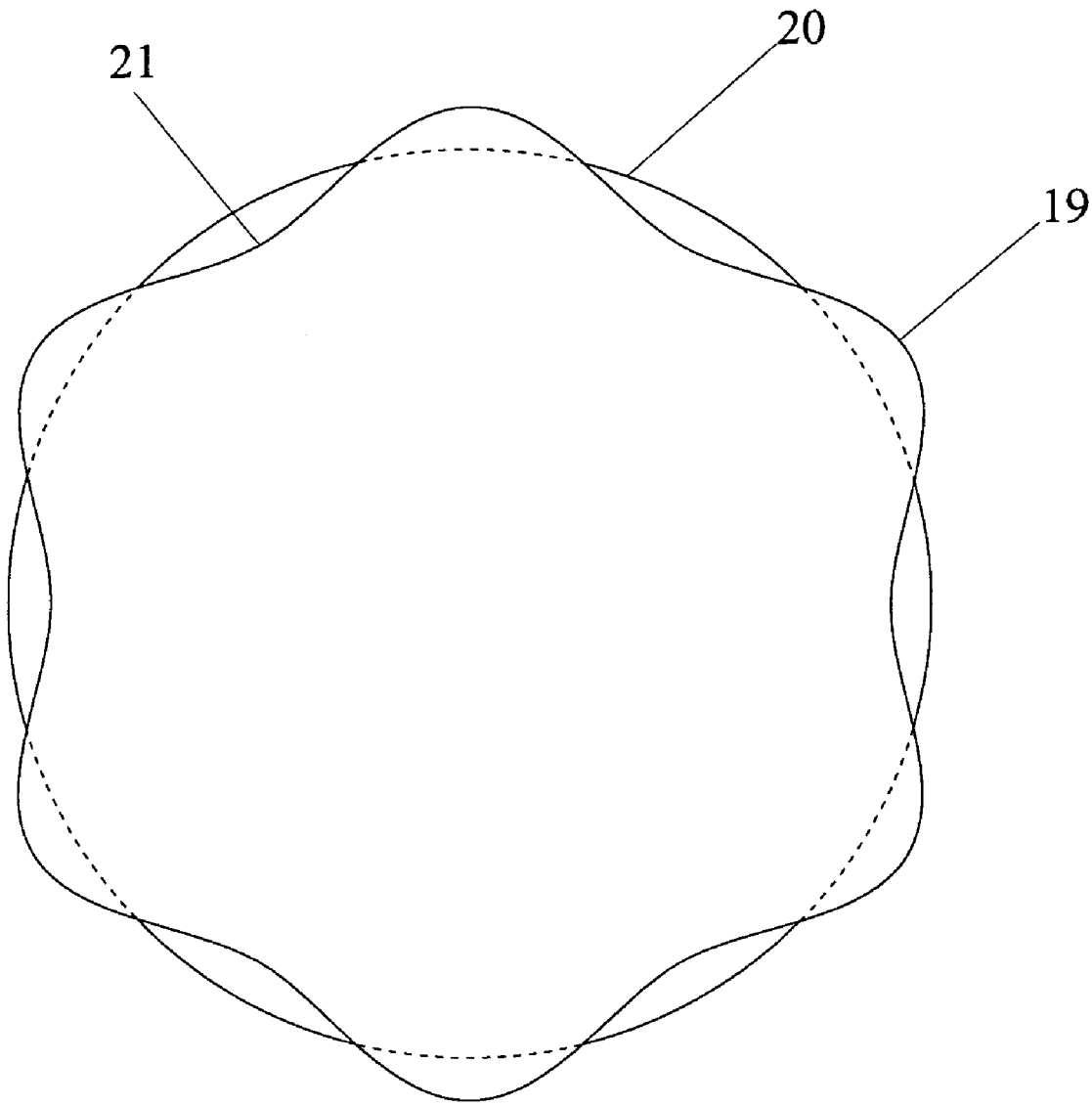
FIG. 3 shows one compacting element in accordance with a third embodiment described herein, as viewed from behind the feed screw.

FIG. 3 shows schematically a part of the outer surface 19 of the bracket wheel in accordance with a third embodiment disclosed herein, with respect to the outer surface 20 of the feed screw, viewed from behind the feed screw. In the example of the figure, there are no separate brackets attached to the surface of the bracket wheel, but the outer surface of the bracket wheel is formed to have brackets. In this solution the bottoms of the bays 21 between the ridges of the brackets are advantageously inside the outer surface of the tail end of the feed screw.

In an embodiment described herein, the bracket wheel advantageously rotates along with the feed screw and thus may be attached to the feed screw in a fixed manner. The bracket wheel may have one or a plurality of brackets, the ridges of said brackets causing radial flow cycles in the concrete mass during the rotation of the wheel. The bays between the ridges of the brackets makes the new, less compacted concrete mass to be extruded via the feed screws for compaction by the brackets. The frequency of the cycles depends on the speed of rotation of the feed screw and on the number of brackets. The number of the brackets is advantageously 1 to 10 brackets on the outer periphery of the bracket wheel.

The embodiments described herein provide improved compactness of the concrete mass and slower wear of the parts of the slipforming machine under pressure. The wear is especially reduced when the hollow-core mandrel is larger than the feed screw. The transversal, cyclic flow pumps concrete mass radially, thereby facilitating passing of the stream over the mandrel that is larger than the feed screw.

The embodiments described herein are not limited to the method and apparatus for casting concrete products having hollow cores, only, as shown in the example of FIG. 1, but can be applied, for example, to the casting of solid slabs. In that case the elements forming the hollow cores are removed from the casting apparatus and only the feed screws along with the bracket wheels are moved reciprocally.

The methods and apparatus described herein can also be implemented with a fixed casting station, wherein the casting apparatus is located in a fixed casting station and the casting bed moves with respect to the casting station. In that case the mobile casting bed moves the finished product out of the fixed casting station and the ready-cast product remains lying on the casting bed.

The invention having been described with respect to certain specific embodiments, it will be understood that these specific embodiments are illustrative, and not limitative, of the appended claims.

The invention claimed is:

1. An apparatus for casting concrete products with a horizontal slipforming process, the apparatus comprising:
- at least one feed element for feeding a concrete mass through a limited cross section for forming a concrete product, comprising:
  - at least one feed screw, and
  - a bracket wheel comprising at least one bracket mounted downstream of the feed screw in the direction of the casting process, wherein said bracket wheel is connected fixedly to an end of the feed screw so that the bracket wheel rotates with the feed screw;
- a mass tank for feeding a concrete mass, disposed upstream of the feed screw;
- a feed chute for guiding the concrete mass to the feed screw, disposed upstream, and at the end of, the feed screw;
- a restricted cross-section disposed downstream of the bracket wheel, and comprising:
  - a casting bed;
  - two side walls; and
  - a troweling beam; and
- a first driving device disposed to impart a rotating motion to the feed screw.

2. An apparatus in accordance with claim 1, wherein the bracket wheel comprises 1 to 10 brackets.

3. An apparatus in accordance with claim 1, wherein the brackets of the bracket wheel have a longitudinal dimension that is parallel to the direction of the casting process.

4. An apparatus in accordance with claim 1, wherein the brackets of the bracket wheel have a longitudinal dimension that is at an angle of 5 to 30 degrees with respect to the direction of the casting process.

5. An apparatus in accordance with claim 1, further comprising:
- a hollow core mandrel disposed at or downstream of the restricted cross-section.

6. An apparatus in accordance with claim 1, further comprising:
- a second driving device disposed to impart a reciprocal longitudinal motion to the feed screw.

7. An apparatus for casting concrete products with a horizontal slipforming process, the apparatus comprising:
- at least one feed element for feeding a concrete mass through a limited cross section for forming a concrete product, comprising:
  - at least one feed screw, and
  - a bracket wheel comprising at least one bracket mounted downstream of the feed screw in the direction of the casting process, wherein said bracket wheel is connected fixedly to an end of the feed screw causes transverse flow in the stream of mass extruded by the feed screw;
- a mass tank for feeding a concrete mass, disposed upstream of the feed screw;

a feed chute for guiding the concrete mass to the feed screw, disposed upstream, and at the end of, the feed screw;

a restricted cross-section disposed downstream of the bracket wheel, and comprising:

a casting bed;

two side walls; and a troweling beam; and a first driving device disposed to impart a rotating motion to the feed screw.

* * * * *